United States Patent [19]

Bocsanczy et al.

[11] 4,211,611

[45] Jul. 8, 1980

[54] COKE OVEN COAL CHARGING DEVICE

[75] Inventors: Janos Bocsanczy; Dieter Stalherm, both of Recklinghausen, Fed. Rep. of Germany

[73] Assignee: Firma Carl Still, Recklinghausen, Fed. Rep. of Germany

[21] Appl. No.: 8,517

[22] Filed: Feb. 1, 1979

[30] Foreign Application Priority Data

Feb. 6, 1978 [DE] Fed. Rep. of Germany ..... 2804935

[51] Int. Cl.[2] ..... C10B 31/04

[52] U.S. Cl. ..... 202/262; 198/589; 198/863; 414/163

[58] Field of Search ..... 202/262, 263; 201/40; 414/163; 193/16; 198/589, 863

[56] References Cited

U.S. PATENT DOCUMENTS

| | | | |
|---|---|---|---|
| 1,268,219 | 6/1918 | Cooley | 193/16 |
| 2,724,514 | 11/1955 | Homan | 414/163 |
| 2,883,076 | 4/1959 | Palmer | 198/589 X |
| 3,830,729 | 8/1974 | King | 202/263 |
| 3,862,888 | 1/1975 | Armour et al. | 202/262 X |
| 3,880,720 | 4/1975 | Wagener et al. | 201/40 X |
| 3,951,750 | 4/1976 | Drebes | 201/40 X |
| 3,959,086 | 5/1976 | Galow et al. | 202/263 X |
| 4,001,092 | 1/1977 | Pries | 202/263 X |

FOREIGN PATENT DOCUMENTS

| | | | |
|---|---|---|---|
| 929888 | 7/1973 | Canada | 202/262 |

*Primary Examiner*—Joseph Scovronek
*Assistant Examiner*—Roger F. Phillips
*Attorney, Agent, or Firm*—McGlew and Tuttle

[57] ABSTRACT

A device for charging coke ovens of a horizontally disposed coke oven battery through charging chute in the roof of each coke oven which is openable at its top and from a coal supply which includes a circulating conveyor for circulating the coal in a path over the roof comprises a transfer conveyor housing having a conveyor operable therein. The transfer conveyor housing is pivotally mounted, and it includes one end with a coal receiving connection which is alignable with a connectable coal transferring opening of the conveyor so as to receive coal therefrom. The other end of the transfer conveyor housing is provided with a connection with may be aligned over an opening of the coke oven for supplying coal into the receiving chute thereof. For this purpose the transfer conveyor housing is pivotally mounted for pivotal movement about a horizontal axis, and it is pivoted so as to bring the connection to the coal transferring opening of the conveyor into alignment below the coal transferring opening and engage with an extension of the chute defining the opening. In addition at the same time, the opposite end is aligned over the coal receiving chute of the oven and it is directed downwardly into engagement therewith so as to define a fuel path between the conveyor through the charging chute.

8 Claims, 3 Drawing Figures

COKE OVEN COAL CHARGING DEVICE

BACKGROUND OF THE INVENTION

1. Field of the Invention

This invention relates in general to the construction of coke ovens and in particular to a new and useful charging device for charging coke ovens with coal.

2. Description of the Prior Art

A device for charging coke oven chambers arranged in batteries is known from German Offenlegungsshrift 2 239 557. In this device, the coal is fed by at least one longitudinal conveyor extending on the battery roof in the direction of the battery axis and through a charging mechanism, in which the conveying surface is a belt which is displaceable in the longitudinal direction and provided with a discharge gate which is equipped with a filling mechanism connectable to the charging ports of the oven chambers.

A particular embodiment of this device provides that the conveyor be mounted on the battery roof along one longitudinal side thereof and that the hopper of the charging mechanism be connected to a transverse feeder spanning the charging holes of an oven chamber and traveling on rails along the longitudinal axis of the battery and designed as a scraper conveyor with vertical fall tubes supporting charging hole connections which are actuable by means of a common lifting and lower mechanism.

A device for charging oven chambers of a coke oven battery with moist or preheated coal by means of chain conveyors extending along the battery is also known from German Offenlegungsshrift 2 336 515, which comprises a 3 to 5 part collecting hopper equipped with 3 to 5 inlet connections which are provided with dust and gas tightly closable sliders, with the connections area being equipped with a telescoping ring establishing a dust and gas-tight connection to the gate of the chain conveyor, and terminating in one or two tubular outlets corresponding to the diameter of the charging hole.

Conventional in the art is an arrangement in which the horizontal conveyor is designed as a feeder or chain conveyor by which the fine coal is received from a coal storage bin and is conveyed through the bottom of its housing directly to the charging chute of the oven chambers to be filled, or to a charging device travelling longitudinally on the battery roof.

In the prior art installations difficulties arise with the connections for transferring the coal from the horizontal conveyors to the machanisms for transferring the coal into the charging chutes, and also with the connections of the latter to the charging chutes. The tightness of these connections is very important for the environmental protection and it depends primarily on whether the sealing parts, for example, the sealing frames or rings are free from tar-bonded coaly deposits. The tightness, however, also depends to a determinative extent on the design of the connection itself and a construction frequently used in practice comprises telescoping tubular parts having their respective ends provided with a sealing member, for example, a sealing ring, to be engaged into a conformable sealing frame of the transfer opening of the horizontal conveyor or of the charging chute of the oven chamber.

A drive is needed for actuating each of these telescoping tubular parts. The expenses thereof are considerable. In addition, the drives as well as the telescoping tubular parts require an intense attendance and cleaning from coal dust and coaly deposits to ensure a reliable function.

SUMMARY OF THE INVENTION

The present invention is directed to a device for transferring coal from a horizontal longitudinal conveyor to the charging chutes of the oven chambers, equipped with less expensive connections which are simpler to attend and to maintain.

To this end and in accordance with the invention, it is provided that the housing of the transverse conveyor is mounted on a trestle of an undercarriage for tilting about a horizontal axis and that the undercarriage and the housing are connected to each other by a mechanically actuable linkage permitting the tilting motion of the housing.

The new device is displaced into its operating position with its housing tilted, thus extending obliquely, and in such a way that its connection to the transfer opening of the horizontal longitudinal conveyor becomes aligned with this opening, and its charging chute connection becomes aligned with the charging chute of the oven chamber to be filled. Then the tilting mechanism is actuated and the housing is brought into a horizontal position in which the sealing members of the housing engage with the sealing members of the horizontal longitudinal conveyor and of the charging chute and, upon raising the cover of the charging chute and opening the closures, the charging operation is performed in the known manner. After termination of the charging operation the closures are closed again, the cover of the charging chute is put in place, and the housing is brought into its tilted position. During this operation the connections become disengaged from the sealing members and the housing can be displaced for serving the next oven chamber.

In accordance with the invention, no telescoping tubular pieces are needed, the connection is effected, in accordance with the invention, by the tiltable housing itself.

The transfer openings of the longitudinal conveyor and the charging chutes of the oven chambers may be arranged and the spacing of the connections of the housing dimensioned so that in every instance two or more oven chambers may be served as from the same transfer opening of the longitudinal conveyor by a simple tilting of the housing and displacement of the undercarriage. For this purpose, the trestle supporting the housing is made pivotable about a vertical axis. A design permitting the charging of two adjacent oven chambers is preferable.

In the same way, the coal may be delivered and brought into the charging chutes of the oven chambers by a plurality of longitudinal conveyors provided on the roof of the battery. For example, one horizontal conveyor may be provided on the roof at the pusher side and another at the coke side, with one or more travelling housings for receiving and transferring coal for each horizontal conveyor.

The arrangement of two horizontal conveyors in the central area of the battery roof is advantageous. This leaves the outer areas of the battery roof free for cleaning devices. The two housings of the transfer devices may be mounted on a common undercarriage.

In a preferred embodiment, the horizontal conveyors are designed as chain conveyors.

The conveying mechanisms in the housing may also be designed as chain conveyors.

For tilting and turning the housing and also for raising the cover of the charging chutes, a common pneumatic drive may be provided, for example.

Accordingly it is an object of the invention to provide an improved device for transferring coal in a closed coal transfer conveyor housing which is pivotally mounted on a roof of a coke oven battery so that it may be pivoted about at least a horizontal axis in order to bring a whole receiving connection into alignment and connection with a coal transferring opening of a conveyor for the coal located above the roof of the oven and to bring an opposite discharging end into alignment with a discharging chute leading to the oven and wherein the housing may be pivoted to shift the housing between the aligned position in which it is engaged with the respective receiving and discharge openings, and a non-aligned position in which it is shifted outwardly therefrom, and including means for at least pivoting the housing about the horizontal axis.

A further object of the invention is to provide a device for discharging coal in a closed path from a circulating conveyor into a receiving chute of a coke oven, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
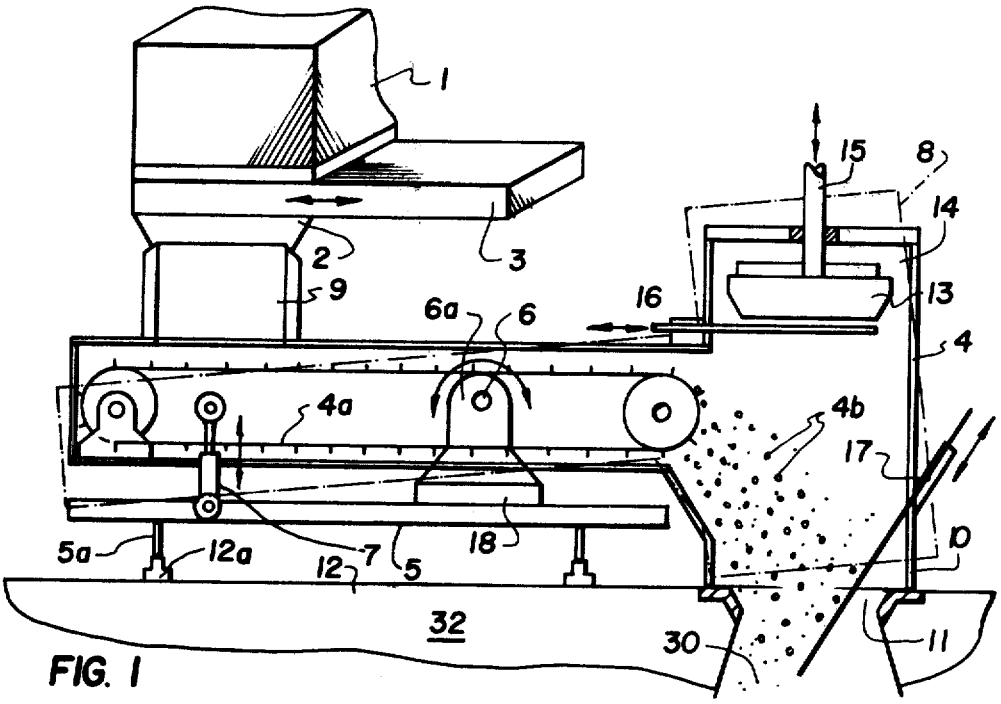
FIG. 1 is a partial schematic side elevational view of a device for transferring coal from a circulating conveyor into a coke oven constructed in accordance with the invention.
Figure 2:
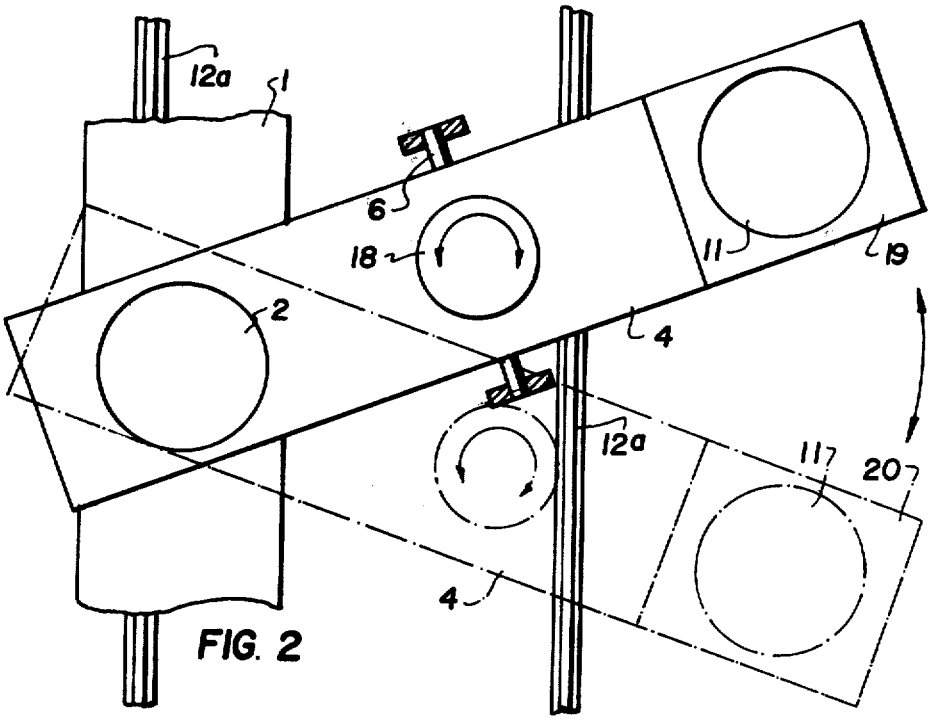
FIG. 2 is a top plan view of the device shown in FIG. 1 indicating the manner in which it may be shifted to service one or more coke oven receiving chutes.

Referring to the drawings in particular, the invention embodied therein in FIGS. 1 and 2 comprises a device for transferring coal from an enclosed longitudinal conveyor 1 into the receiving chute or charging opening 11 of a coke oven 30 of a coke oven battery generally designated 32.

In accordance with the invention, an enclosed longitudinal conveyor, which in the embodiment shown comprises a chain conveyor extends about 2 meters above a roof 12 of a coke oven battery and is supported on posts which are not shown. This elevated arrangement avoids difficulties with the movement on the roof of the battery. The coal transfer openings 2 with the closing sliders 3 are provided on the underside of chain conveyor 1. A housing 4 of a transverse chain conveyor 4a is mounted on a trestle 6a of an undercarriage 5 for tilting motion about a pivot pin 6. Housing 4 is equipped for filling poorly sliding coal, for example, moist coal, with the charging chain conveyor 4a. For charging well sliding coal, for example, predried or preheated coal, the conveyor 4a may be replaced by a simple transfer chute. Housing 4 is tilted about pin 6 by an electrically or hydraulically driven lever arm or piston-cylinder drive 7. For travelling on the battery roof, the housing 4 on undercarriage 5 is brought into an oblique travelling position which is designated at 8 and shown in dotted lines in FIG. 1. By means of lever arm 7 housing 4 is brought into a horizontal position over an oven chamber 30 to be charged and the connections or extensions 9 and 10 of housing 4 are tightly connected to the transfer opening 2 of the chain conveyor 1 and to the charging chute 11 of oven chamber 30, respectively. The contact pressure with which the closing members are pressed against each other may be adjusted at the drive of lever arm 7 as needed. To charge the oven chamber, the magnetic cover raising mechanism 15 accomodated in a dome-like extension 14 of housing 4 lifts the charging chute cover 13 from chute 11 and displaces it into the extension 14. For reasons of safety, a supporting arm 16 is introduced below the lifted chute cover 13 preventing the cover from falling down. Upon opening shut-off slider 3 and setting chain conveyors 1 and 4a in operation, the charging may be started and the coal 4b flows through charging chute 11 into oven chamber 30.

A measuring probe 17 for the coal level extends into the oven chamber 30. As the charging operation is terminated, first chain conveyor 1 and then, with a delay of about 10 seconds, chain conveyor 4a are stopped. In this way, residual coal amounts on chain conveyor 4a are avoided. Then cover 13 is put in place on charging chute 11 to seal the oven 30, and slider 3 is brought into a closing position. By actuating lever arm 7 parts 2 and 9 as well as 10 and 11 are disengaged from each other and housing 4 is brought in an oblique travelling position 8. The undercarriage 5 may be displaced on wheels 5a along a trackway 12a on the roof 12 to the next oven chamber to be filled.

In FIG. 2 a vertical pivot 18 of trestle 6a is shown. By turning housing 4 with trestle 6a about pivot 18 and a small longitudinal displacement of undercarriage 5 on the wheels 5a and the rails 12a (FIG. 1), housing 4 can be brought both into the solid line position 19 or into the position 20 indicated in dotted lines, and two adjacent oven chambers can be filled from the same transfer opening 2. For this purpose, it is only necessary to have the centers of the charging chutes of adjacent oven chamber positioned on circular arcs having a radius which is equal to the mean spacing of connection 9 from connection 10.

Figure 3:
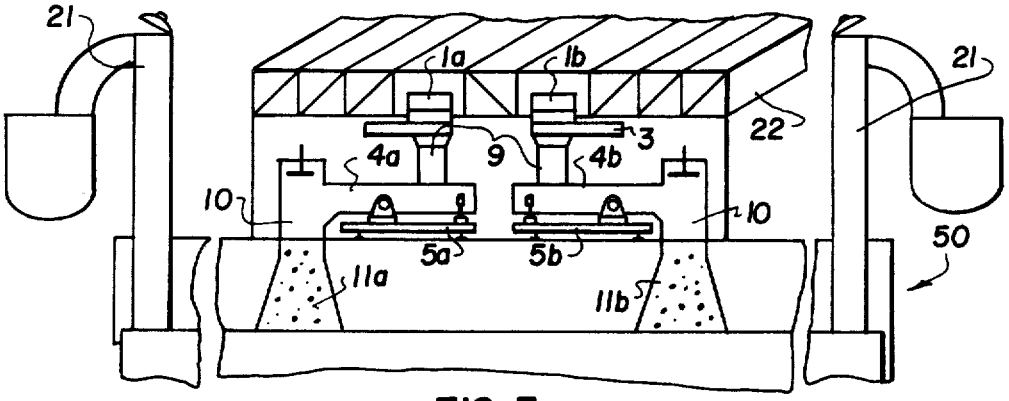
FIG. 3 is a diagrammatic perspective view of a coke oven of another embodiment of the invention.

FIG. 3 shows two longitudinal conveyors 1a and 1b which are arranged in the interior zone of the roof of a coke oven battery 50, and two undercarriages 5a, 5b with housings 4a, 4b make it possible to serve two charging chutes 11a and 11b of one and the same or of two different oven chambers. Risers or stand pipes 21 of the oven chambers with their covers, bends and the collecting mains are shown. In this design, the two longitudinal conveyors 1a and 1b are supported by a common bridge structure 22. Advantageously, the charging chutes of an oven chamber are provided symmetrically of the central axis of the battery, spaced from this axis by a distance of about 2 to 3 m. Thus, a large free lateral area remains on the roof of the battery for cleaning devices for the risers 21 and their bends, as well as for the roof itself.

While specific embodiments of the invention have been shown and described in detail to illustrate the application of the principles of the invention, it will be understood that the invention may be embodied otherwise without departing from such principles.

What is claimed is:

1. A device for charging coke into a plurality of coke ovens arranged in a coke oven battery having a roof, each of said coke ovens having a chamber and a charging chute which is openable at the roof wherein coal is supplied above the roof through a transferring chute which is openable to discharge the coal, comprising a transfer conveyor housing having a coal receiving connection adapted to be aligned with the transferring chute and a coal discharge connection alignable with the charging chute of the oven and which is located at a laterally spaced location from said coal receiving connection, conveyor means in said housing between said coal receiving connection and said discharge connection for conveying coal therebetween, pivot means supporting said housing for pivotal movement at least about a substantially horizontal axis, and drive means connected to said housing for moving said housing to simultaneously align and sealingly connect said coal receiving connection of said housing with said transferring chute and said coal discharge connection of said housing with said coal charging chute.

2. A device according to claim 1 wherein said pivot means supports said conveyor housing for pivotal movement about both a horizontal and a vertical axis.

3. A device according to claim 1 including at least one horizontal supply conveyor disposed above said roof having at least one of said transferring chutes through which the coal is directed and including means for supporting said housing for movement along said roof below said horizontal conveyor.

4. A device according to claim 1 including at least two horizontal conveyors mounted above said roof and overlying said coal transfer conveyor housing, said housing being pivotal about a horizontal axis to align the coal receiving connection with the coal transfer connection and the coal discharge connection with the charging chute, said housing being pivotal about a vertical axis to shift the discharge connection in an arc for alignment over a different charging chute.

5. A device according to claim 1 wherein there are two longitudinal conveyors mounted on said battery roof in the middle of said roof, including a trackway on which said transfer conveyor housing is movable, said transfer conveyor housing including a carriage engaged on said trackway.

6. A device according to claim 1 including at least one supply conveyor comprising a chain conveyor mounted on the roof of said coke oven battery.

7. A device according to claim 1 wherein said conveyor means comprises a chain conveyor.

8. A device according to claim 1, further comprising an undercarriage, said pivot means and said drive means being mounted on said undercarriage, wheel means connected to said undercarriage for moving said housing over said roof.

* * * * *